US005335645A

United States Patent [19]

Simonds et al.

[11] Patent Number: 5,335,645

[45] Date of Patent: Aug. 9, 1994

[54] BOW HANDLE

[75] Inventors: Gary L. Simonds; Henry M. Gallops, Jr., both of Gainesville, Fla.

[73] Assignee: Bear Archery Inc., Gainesville, Fla.

[21] Appl. No.: 933,670

[22] Filed: Aug. 24, 1992

[51] Int. Cl.[5] ..... F41B 5/00

[52] U.S. Cl. ..... 124/88; 124/23.1

[58] Field of Search ..... 124/23.1, 25.6, 88

[56] References Cited

U.S. PATENT DOCUMENTS

| | | | |
|---|---|---|---|
| 3,415,240 | 12/1968 | Bear | 124/23.1 |
| 3,659,577 | 5/1972 | Richardson et al. | 124/23.1 X |
| 3,923,036 | 12/1975 | Jennings et al. | 124/88 |
| 4,693,230 | 9/1987 | Sugouchi | 124/88 |
| 5,113,841 | 5/1992 | Bratcher | 124/23.1 |

FOREIGN PATENT DOCUMENTS

| | | | |
|---|---|---|---|
| 2580795 | 10/1986 | France | 124/23.1 |

*Primary Examiner*—Randolph A. Reese
*Assistant Examiner*—John Ricci
*Attorney, Agent, or Firm*—Malina & Wolson

[57] ABSTRACT

A strong, lightweight metal handle for a compound bow. The bow handle may be machined from a bar of stock metal such as aluminum or an alloy thereof. The handle is formed with one or more recesses or one or more recesses can be thereafter machined out of the handle. The recess or recesses extend from the side of the handle under compression when the compound bow is drawn and extend toward the side of the handle which is under tension when the bow is drawn.

8 Claims, 2 Drawing Sheets

BOW HANDLE

STATEMENTS AS TO RIGHTS TO INVENTION MADE UNDER FEDERALLY SPONSORED RESEARCH AND DEVELOPMENT

The invention disclosed and claimed herein was not made under any federally sponsored research and development program

BACKGROUND OF THE INVENTION

1. Field of the Invention

The present invention relates generally to archery equipment and more particularly pertains to improved bow handles for archery bows.

2. Description of the Prior Art

Archery bows in their basic form include a bow handle, upper and lower resilient limb portions extending therefrom, and a bowstring attached to the upper and lower limbs.

In operation, as the archer draws the bowstring, the upper and lower limbs are flexed and potential energy is stored therein. When the archer releases the bowstring, the stored energy in the limbs propels the bowstring and the arrow nocked thereon forwardly. The greater the energy required to flex the limbs the greater will be the energy available to propel the arrow when the bowstring is released. Arrow acceleration, arrow speed, the distance the arrow will travel, and the force with which it will strike the target are directly related to the force with which the arrow is initially launched.

Compound bows, in general, because of the mechanical advantage obtained through the cam system of such bows, are able to store significantly more energy in their bow limbs than are simple bows. However, the bending moments produced by the relatively widely separated stiff bow limbs of compound bows are large, and commonly require larger, more massive cast, forged or machined handles. Such handles have been typically constructed of lower strength materials such as wood, metallic composites of magnesium, and aluminum, the latter of which are formed by shaping, casting or forging. But because these lower strength materials had to withstand the large bending moments produced by the flexure of the limbs, and since the grip was a portion of the load bearing member, more handle mass was required to achieve the desired strength. An exception was the use of high strength aluminum forgings to produce bow handles. There are disadvantages in producing handles in this manner including the fact that the fabrication process to produce such forgings is expensive.

Since archery bows, particularly those used for hunting, are required to be lightweight and portable, the low strength compound bow handles which require increased size and weight to achieve the desired strength have distinct disadvantages.

On the other hand, the relatively lightweight, high strength aluminum forged handles, capable of operating at higher stress levels, have not, until the recent past, been commercially practical. Handles machined from solid billets of aluminum alloy were introduced a number of years ago. But then the machining process was also time consuming and costly.

As a result machined bow handles made of solid aluminum alloy stock were replaced by cast alloy handles which were far less expensive.

The introduction of less costly CNC (computer numerically controlled) machines for accurately and less expensively machining metal into whatever shape is desired, has made the reintroduction of machined compound bow handles both more cost effective and practical. Such machined metal compound bow handles are presently employed in the more expensive market lines of some bow manufacturers. Bow handles machined of solid metal exhibit better and more consistent material properties than those handles currently produced by sand or die castings.

Many aluminum and aluminum alloys generally, exhibit at least a one-third increase in strength over die cast aluminum or magnesium because they do not have air entrapped in the material that is associated with die cast products. Aluminum, however, is one-third denser than magnesium and provides a substantially stronger bow handle, but one that is heavier. Additionally, machined handles of varying configurations can be fabricated by changing the computer program of the CNC machine at a relatively modest cost.

It has been the practice to reduce the weight of the die cast magnesium handles by coring the areas of the limb mounts and the sight mounting side of the handles within the sight window area. Additional coring has been applied to the handle below the grip on both the sight mounting side and the sight window side.

Another approach to reduce the weight of a bow handle, as described in U.S. Pat. No. 3,923,036 issued to Thomas P. Jennings, et al, is to provide the handle with thin central beam sections formed having thin transverse side and cross rib patterns on the sight window and sight mounting sides of the handle, to stiffen and strengthen the handle. The intersection of the cross ribs and side ribs form recessed void regions in the ribbed surface which are bounded by rigid connections of the cross ribs and side ribs. The weight of the handle is, thus, reduced due to the void regions. The recessed void regions extend in a direction between the sight mounting side and the sight window side of the bow handle but do not extend therethrough to define an opening. This design, by taking advantage of using aluminum alloys of superior strength and employing a minimum of material, provides a lightweight bow handle having a high strength to mass ratio.

Manufacturers of machined billet aluminum bowhandles also seek the produce strong bow handles while reducing the overall weight of the bow. One prior art approach has been to reduce the bow handle cross-section area but in so doing the machined material is subjected to higher bending stresses. Such cross-sections typically comprise configurations that are oval, rectangular or combinations thereof. Such cross-sections exploit good strength properties because they have high moments of inertia about each axis. The cross-sectional material that contributes the most strength is that which is located farthest from the neutral bending axis of the section while the portion contributing least to the strength is closest to the neutral axis. The problem however with solid cross-section handles is their large mass weight. Therefore, in most cases it would be possible to improve the strength to weight ratio of a solid section by removing some of the material nearest the neutral axis of the section.

A known approach to weight reduction has been to form the handle cross-section into a "C", "E", or "I" configuration or variations thereof along the bow handle length with weight reducing holes transversely through the section along the bending axis. A recent solution being used, which is embodied in bows sold by Alpine Archery, PSE Archery, York Archery and Indian Archery includes machining out openings of various shapes through the handle from the sight mounting side and in the direction of the sight window side.

SUMMARY OF THE INVENTION

The present invention comprises a compound bow handle that is machined from bar stock metal such as aluminum. The handle may be formed to include an upper offset sight window portion and a lower hand grip portion and it is attached and supported between the limbs of the compound bow. The sight window may have an arrow rest ledge perpendicular to the direction of arrow flight and the bending plane of the bow. Although, in forming the sight window portion of the bow handle, bow handle material has been removed, additional weight reduction is provided by removing additional material without appreciably lowering the strength of the bow handle and thereby the compound bow itself. This material is removed from the bow handle by machining recesses in the handle with the recesses extending from the compression side of the handle. The compression side of the handle is the side that faces the archer when the bow is held in drawn position by the archer. These recesses are generally in the bending plane of the compound bow and in the direction of arrow flight.

Accordingly, it is an object of this invention to provide an improved compound bow employing a machined metallic bow handle which is relatively lightweight and exhibits high strength to weight ratio.

Another object is to provide a compound bow handle which can be machined from metallic bar stock and is lightweight and exhibits superior strength characteristics.

Other objects and many of the attendant advantages of this invention will be readily appreciated as the same becomes better understood by reference to the following detailed description when considered in connection with the accompanying drawings in which like reference numerals designate like parts throughout the figures thereof.

DETAILED DESCRIPTION OF THE PREFERRED EMBODIMENT

Figure 1:
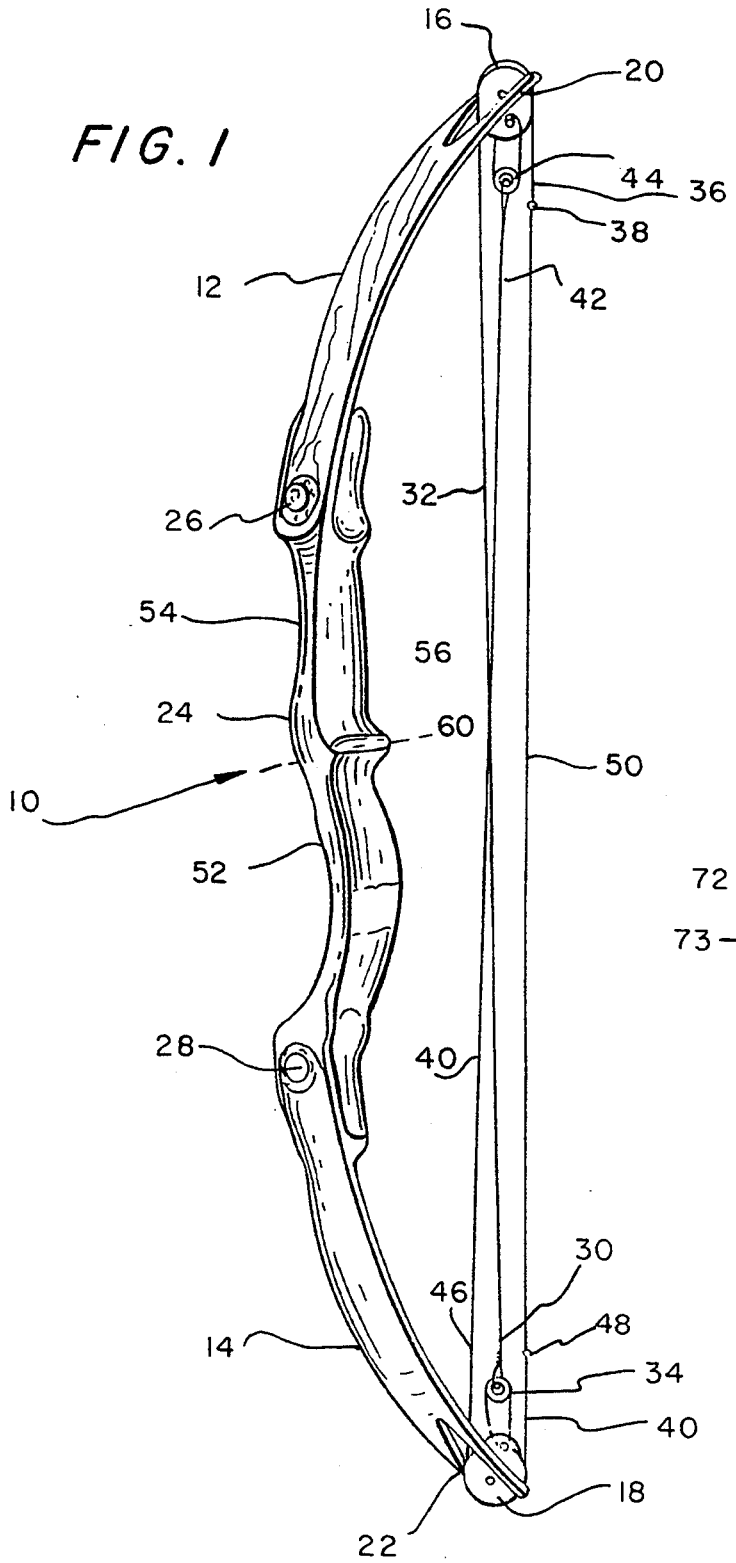
FIG. 1 is a perspective view of an embodiment of the compound bow including a handle constructed in accordance with the present invention.

In the illustrated embodiment of FIG. 1 a compound bow generally designated at 10 includes a pair of opposed bow limbs 12 and 14 which carry centrally disposed eccentric pulleys 16 and 18 at their ends. The upper eccentric pulley 16 is mounted within the upper pulley support section 20 while the lower eccentric pulley 18 is similarly mounted within the lower pulley support section 22. The limbs 12 and 14 are joined to a centrally disposed bow handle 24 by any suitable means such as draw weight adjusting bolts 26 and 28. The handle 24 may be formed of aluminum or an aluminum alloy, and the profile of the handle 24 may be formed as by machining. One end 30 of anchor line 32 may terminate in a load equalizing yoke assembly 34, which in turn is attached to eccentric axle 17. Alternately anchor line 32 could be connected directly to the eccentric axle 17 on one side or the other of the eccentric cam member 18. The other end of anchor line 32 passes over upper eccentric pulley 16 and at its opposite end 36 carries a bowstring coupler 38, or its opposite end 36 can be attached directly to the eccentric pulley 16. The opposed anchor cable 40 at one end 42 is connected to a load equalizing yoke assembly 44 which in turn is attached to eccentric axle 19. Alternately anchor line 42 could be connected directly to the eccentric axle 19 on one side or the other of the eccentric pulley 16. The other end of anchor cable 40 passes over lower eccentric pulley 18 while its opposite end 46 carries a bowstring coupler 48. Bowstring 50 is connected between bowstring couplers 38 and 48. It is also possible for the other end of anchor cable 40 to be anchored in eccentric pulley 18 in which case the bowstring 50 would have one of its ends anchored in eccentric pulley 18 and the other end anchored into eccentric pulley 16.

Figure 3:
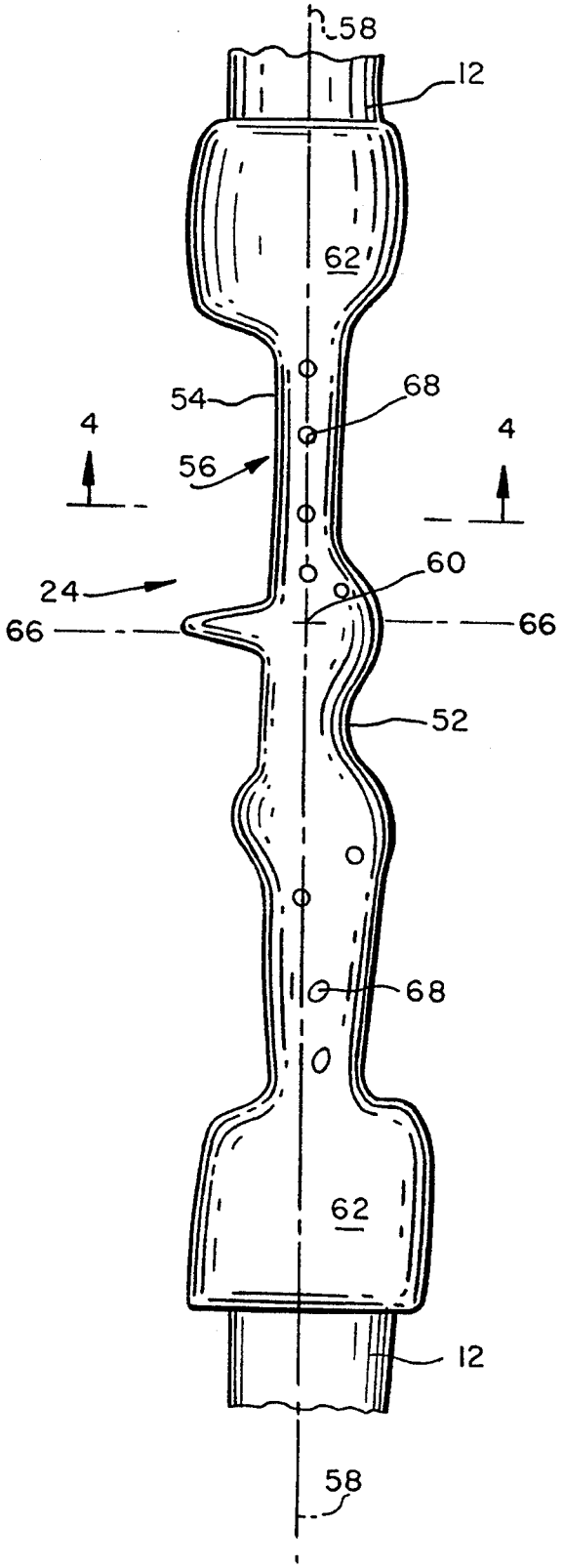
FIG. 3 is a rear elevational view of the embodiment of FIG. 2 taken along line 3—3 of FIG. 2 viewed in the direction of the arrow.

As illustrated in FIG. 3 the bow 10 includes a bow vertical axis 58 which extends from the upper pulley support section 20 through the center of upper limb 12, through the bow handle 24 to the lower pulley support section 22.

Figure 2:
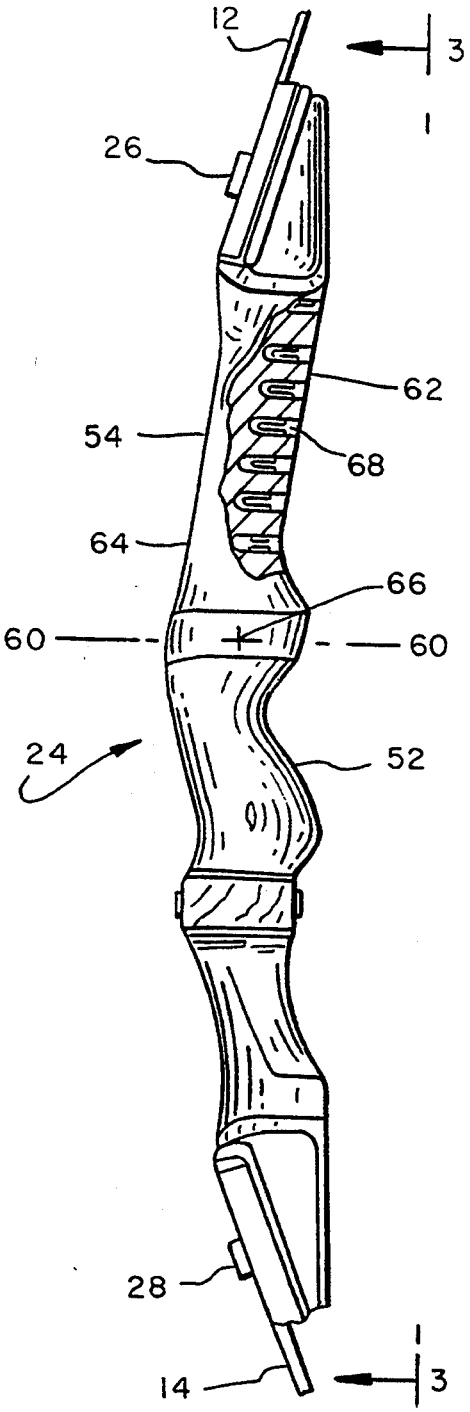
FIG. 2 is a side elevation view of the embodiment of FIG. 1 showing the bow handle with a portion thereof partially removed.

Vertical axis 58 is perpendicular to the arrow trajectory axis 60. Arrow trajectory axis 60, as shown in FIG. 1, is approximately equidistant from the upper eccentric pulley 16 and the lower eccentric pulley 18. The arrow trajectory axis 60 is actually slightly above the center of the bow handle 24 and extends from the bow handle inner surface 62 (see FIG. 2), which faces the archer when the bow 10 is held in the shooting position, through the bow handle 24 to the bow handle outer surface The axis about which the bow limbs 12 and 14 bend is defined as the bow bending axis 66 and is perpendicular to both the bow vertical axis 58 and the arrow trajectory axis When the compound bow 10 is drawn, prior to launching, the limbs 12 and 14 are caused to deflect about the bending axis 66. The bow handle 24 is subjected to bending forces whereby bow handle outer surface 64 is under tension and bow handle inner surface 62 is under compression. Intermediate the bow handle outer surface 64 and the bow handle inner surface 62 there exists a neutral plane which is under neither compression or tension.

The design of a compound bow handle requires consideration of a number of factors including the complex loading conditions. During drawing of a compound bow and arrow release a plurality of moments and forces act on the bow handle. These forces and moments include a primary bending moment, a secondary moment tending to bend the bow handle toward the sight window and a torque caused by the offset eccentric pulleys and the sight window.

The primary reason for bow handle fatigue failure is caused by the combined stresses resulting from the complex loading as previously described being applied to the handle over the large number of arrow launching cycles to which the bow handle is subjected. Fatigue failure occurs when a component is repeatedly subjected to fluctuating tensile stress greater than the endurance limit stress of the material from which the component is fabricated. For example, with respect to the present illustrated embodiment, under such conditions cracks can develop in the handle 24 and under repeated loadings these cracks will propagate from the outer surface 64 (tension side) through the handle 24 until the handle 24 can no longer withstand the imposed loads and fails. Fatigue stress can not start from the inner surface 62 (compression side) of the bow handle 24 because the handle material must be in a tensile loading condition to propagate a crack.

A bow handle machined from an aluminum or aluminum alloy stock is generally more homogenous and exhibits more predictable physical characteristics than a similar die cast magnesium bow handle. Such a machined bow handle, however, is heavier than its magnesium counterpart. In order to reduce the weight of a machined bar stock bow handle it is desirable to remove more stock material from the bow handle. In doing so it is desirable to minimize any resulting loss of bow handle strength in opposing the bending moments and torques caused when the bow is drawn and released. Again with respect to the present illustrated embodiment, the machined bow handle 24 includes a hand grip portion 52 and an offset portion 54 which defines a sight window 56. The present bow handle 24 is preferably formed and shaped by machining aluminum or aluminum alloy bar stock. Stock material is removed from the bow handle 24 starting from the bow handle inner surface 62 and extending toward but short of the outer bow handle surface 64. The material thus removed starts at the area of the greatest compressive bow handle loading. Material removal can be accomplished in a variety of ways such as, including but not limited to drilling or milling. One preferred method is to mill recesses 68 to within a fraction of an inch of surface 64 into the bow handle 24 which recesses 68 are oriented vertically along the bow handle 24. A suitable vertical pattern of the recesses 68 is one that extends into the handgrip portion 50 but remains sufficiently below the low point of the hand grip portion 50 away from the area of minimum cross-section. The recesses 68 are void, that is, they do not contain any mass.

Figure 4:
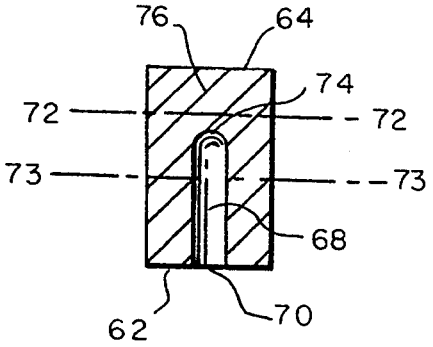
FIG. 4 is a cross-sectional view of the embodiment of FIG. 3 taken along line 4—4 of FIG. 3 viewed in the direction of the arrows.

Removing stock material from the bow handle 24 as by drilling, or milling into the bow handle 24 from the inner surface 62 (compression side) results in an inverted "U" shaped cross-sectional recess 68 as shown in FIG. 4. The open end 70 is on the compression side of the neutral axis 72 (see FIG. 4). The closed end 74 of the recess 68 is located closer to the tension side 76 of the neutral axis 72. The configuration of the horizontal cross-section of bow handle 24 between the recesses 68 (except for the handgrip portion 52) is approximately a rectangular solid section. The neutral axis of this solid section is designated at 73. The neutral axis of rectangular and "I" beam configurations is at approximately the physical center thereof. For the "U" shaped recess cross-sectional configuration as illustrated in FIG. 4, the neutral axis 72 has been shifted toward the closed end 74 of recess 68. The stress present at a particular area of the handle is the product of the moment of inertia and the distance of the surface being considered from the neutral axis divided by the inertia of the cross-section of the handle at that point. This shifting of the neutral axis 72 towards the closed end 74 results in an overall reduction in the maximum tensile stress to which the handle 24 is subjected as compared to an "I" beam or rectangular configuration where the neutral axis 73 is centrally located. The reason being that the distance from the shifted neutral axis 72 to the bow handle outer surface 64 has been reduced.

Utilization of a combination of recesses having "U" shaped cross-sections with rectangular cross-sections as described above, provides a strong, lightweight bow handle.

This method is also intended to be used in conjunction with other material removal methods such as removing material in the zero stress areas along the neutral axis in a plane perpendicular to the plane passing through axis 58 and containing the lightening pockets as described herein above.

Obviously many modifications and variations of the present invention are possible in the light of the above teachings. It is therefore understood that, within the scope of the appended claims, the invention may be practiced otherwise than specifically described.

Having thus described the invention, what is claimed as novel and desired to secure by Letters Patent is:

1. An archery bow having a handle comprising a central handgrip portion said handle having an upper portion and a lower portion for connection to an upper bow limb and a lower bow limb, said handle including an inner surface subjected to compression and an outer surface subjected to tension when said bow is drawn, at least one void recess formed in said handle and extending inwardly from said inner surface toward but short of said outer surface for the purpose of reducing the mass of the handle and wherein said recess extends into said handle to a depth beyond the neutral axis of said handle.

2. An archery bow having a handle as set forth claim 1 wherein said handle includes a plurality of recesses.

3. An archery bow having a handle as set forth in claim 2 wherein said recesses ar oriented vertically and spaced apart along said handle.

4. An archery bow having a handle as set forth in claim 1 wherein the handle profile is machined.

5. An archery bow having a handle as set forth in claim 1 wherein said recess in the handle is formed by machining.

6. An archery bow having a handle as set forth in claim 1 wherein the handle is formed of aluminum.

7. An archery bow having a handle as set forth in claim 1 wherein the handle is formed of an aluminum alloy.

8. An archery bow having a handle as set forth in claim 1 wherein said handle is formed by casting.

* * * * *